US009774095B1

(12) United States Patent
Fenner

(10) Patent No.: US 9,774,095 B1
(45) Date of Patent: Sep. 26, 2017

(54) ANTENNA SYSTEM WITH MULTIPLE INDEPENDENTLY STEERABLE SHAPED BEAMS

(75) Inventor: Guy David Fenner, Hood River, OR (US)

(73) Assignee: Space Systems/Loral, LLC, Palo Alto, CA (US)

( * ) Notice: Subject to any disclaimer, the term of this patent is extended or adjusted under 35 U.S.C. 154(b) by 1120 days.

(21) Appl. No.: 13/240,079

(22) Filed: Sep. 22, 2011

(51) Int. Cl.
*H01Q 21/00* (2006.01)
*H01Q 1/12* (2006.01)

(52) U.S. Cl.
CPC ..... *H01Q 21/00* (2013.01); *H01Q 1/1264* (2013.01)

(58) Field of Classification Search
CPC ..... H01Q 1/1264; H01Q 3/18; H01Q 19/192; H01Q 25/007
USPC ..... 343/761, 781 P, 781 CA, 834–837
See application file for complete search history.

(56) References Cited

U.S. PATENT DOCUMENTS 3,383,692 A 5/1968 Laibson et al.
3,680,141 A * 7/1972 Karikomi ..... H01Q 19/191 343/758
3,914,768 A 10/1975 Ohm
3,953,858 A * 4/1976 Ohm ..... 343/779
4,298,877 A * 11/1981 Sletten ..... 343/781 CA
4,355,314 A 10/1982 Ohm
4,535,338 A 8/1985 Ohm
4,586,051 A * 4/1986 Saitto et al. ..... 343/703
4,603,334 A 7/1986 Mizuguchi et al.
5,198,827 A 3/1993 Seaton
5,485,168 A 1/1996 Parekh
5,796,370 A * 8/1998 Courtonne ..... H01Q 3/16 343/761
6,211,835 B1 4/2001 Peebles et al.
6,236,375 B1 5/2001 Chandler et al.
6,239,763 B1 5/2001 Cuchanski
6,320,553 B1 * 11/2001 Ergene ..... 343/781 P
6,424,310 B1 7/2002 Broas et al.
6,441,794 B1 8/2002 Tang et al.
6,977,622 B2 12/2005 Hay et al.
7,161,549 B1 1/2007 Cuchanski et al.
2004/0222932 A1 11/2004 Peebles et al.
2006/0250316 A1 11/2006 Smith et al.

* cited by examiner

*Primary Examiner* — Jean B Jeanglaude
(74) *Attorney, Agent, or Firm* — Weaver Austin Villeneuve & Sampson LLP

(57) ABSTRACT

An antenna system having a main reflector and at least two subreflectors is configured to provide at least two independently steerable beams. Each subreflector is configured to illuminate the main reflector, and each subreflector is configured to be illuminated by a respective dedicated feed element or dedicated feed array. At least one of the subreflectors is configured to steer a first beam, without affecting the shape or orientation of any other beam. One or more of the beams may also be independently shaped, by a contoured surface of one or more subreflectors and/or the main reflector.

22 Claims, 3 Drawing Sheets

ANTENNA SYSTEM WITH MULTIPLE INDEPENDENTLY STEERABLE SHAPED BEAMS

TECHNICAL FIELD

This invention relates generally to antenna systems, and particularly to techniques for generating multiple independently-pointed, beams from a single antenna.

BACKGROUND

The assignee of the present invention manufactures and deploys spacecraft for, inter alia, communications and broadcast services from geostationary orbit. Market demands for such spacecraft have imposed increasingly stringent requirements on spacecraft payloads. For example, service providers desire spacecraft with payloads offering reconfigurable service to multiple coverage areas.

Satellite payloads generally include one or more antenna systems configured to project beams of a certain shape for transmitting and/or receiving radio waves. For example, an antenna system of a geostationary satellite may be configured to project a beam that is roughly the shape of a geographic region, such as the boarders of a country, or a small "spot" beam covering a single city or region. As a further example, the satellite payload may be constrained to avoid transmitting to and/or receiving from certain regions in accordance with government regulatory requirements, and/or to avoid interference to and/or from other users of the same frequency spectrum in those regions. In order to maximize the utility of a satellite, it is often desirable to operate as many beams as possible from a single satellite. In light of mass and envelope constraints, it is desirable to generate multiple beams from each antenna system.

As observed by Lyerly et al., in US Pat Pub 2004/0008148 (hereinafter "Lyerly") a satellite reflector antenna may be configured to produce a shaped beam that corresponds to the shape of a particular market region by using an array of multiple feeds (a "feed array") placed at the reflector focus region in order to produce the desired shape in the antenna far field pattern. For example, by varying the amplitude and phase excitation of each feed in the feed array, multiple desired beam shapes may be generated. A combiner network is used to distribute energy to each of the many feeds required to produce the shaped beam. The consequential result is an increase in weight and volume to the satellite antenna system as well as a risk of undesirable electrical coupling between feeds. Moreover, there is very limited capability to reconfigure the shaped beam, the parameters of which are largely fixed by initial design of the feed array.

A requirement for multiple feeds may sometimes be avoided by employing a shaped main reflector and/or subreflector or both. By "shaped", as used herein and in the claims, is meant that a substantially paraboloid, ellipsoid, or hyperboloid reflector surface is additionally specially contoured so as to provide a desired beam shape. Because each feed element is associated with a single shaped beam, a need for a feed array and a combiner network may be substantially avoided. As a result, the weight, volume, cost and complexity of the antenna system are reduced. In the absence of the present teachings, however, an ability to independently steer and shape an individual beam, without affecting other beams produced by the antenna system, can be provided only with substantial penalties of mass, cost and reliability.

For example, in a known technique, one or more feeds may be provided that independently translate relative to the reflector or subreflector. The feeds must be connected to a transponder in order to receive and amplify radio signals. For the feed to move, it must be connected either with a beam waveguide, or flexible waveguide or cable. A beam waveguide requires multiple additional reflectors, is relatively heavy, and consumes a large amount of space. Flexible waveguide is prone to failure after repeated bending, and cable is lossy and cannot carry much power without overheating.

In view of the above, improved techniques for generating multiple independently-steered and shaped beams from a single antenna system are desirable.

SUMMARY

The present inventor has appreciated that independently steerable beams may be advantageously provided by an antenna system having a main reflector and at least two subreflectors illuminating the main reflector, each subreflector illuminated by a respective dedicated feed element, where at least one subreflector is configured to steer at least one beam. Advantageously at least one subreflector may be contoured so as to provide beam shaping.

In an embodiment, at least one subreflector may be configurably disposed between the main reflector and a respective dedicated feed element so as to reflect energy between the feed and the main reflector in order to produce a reconfigurable beam pattern during operation of the antenna. For example, an orientation and/or position of the subreflector may by adjustable by a gimbal and/or a translation actuator configured independently of any other subreflector. As a result, a radio frequency (RF) beam associated with that subreflector may be independently steered. In an embodiment, the antenna system is part of a satellite payload, and the subreflector position and orientation to provide the desired beam pointing may be adjusted in response to commands originated either on the satellite or from a ground station in communication with the satellite.

In an embodiment, an antenna system includes a main reflector and at least a first subreflector and a second subreflector. Each subreflector is configured to illuminate the main reflector, and each subreflector is configured to be illuminated by a respective dedicated feed element or dedicated feed array. The first subreflector is configured to steer a first beam; and the antenna system is configured to provide at least two independently steerable beams.

In another embodiment, the first subreflector may be configured to steer a first beam without affecting the orientation or shape of any other beam of the antenna system.

In a further embodiment, the second subreflector may be configured to steer a second beam, independently of the first beam. The antenna system may be configured to steer the second beam by reorienting or translating the second subreflector. The antenna system may be configured to steer both beams by reorienting the main reflector In a still further embodiment, the antenna system may be configured to shape at least one of the first beam and the second beam. At least one of the first subreflector and the second subreflector may have a contoured surface so as to provide beam shaping. The main reflector may have a contoured surface so as to provide beam shaping.

In an embodiment, the antennas system may have an offset-fed Gregorian or Cassegrain geometry.

In another embodiment, the antenna system may have a respective gimbal mechanism and/or a respective translation mechanism, wherewith the first subreflector may be configured to steer the first beam.

In some embodiments, the at least one beam may be dynamically steered in response to a control signal. The control signal may be generated from the ground or from the spacecraft.

In a further embodiment, the feed element is at least one of a horn, helix, dipole, microstrip or a small array of similar feed elements for feeding signals to/from the subreflectors.

In an embodiment, the respective feed elements operate at different frequency bands.

In another embodiment, the respective feed operate at a common frequency band.

In an embodiment, a spacecraft includes a control system; and an antenna system. The antenna system includes a main reflector and at least a first subreflector and a second subreflector. Each subreflector is configured to illuminate the main reflector, and each subreflector is configured to be illuminated by a respective dedicated feed element or dedicated feed array. The first subreflector is configured to steer a first beam; and the antenna system is configured to provide at least two independently steerable beams. The control system is configured to control at least one of a position and an orientation of at least one subreflector, so as to provide beam steering.

In another embodiment, the control system may be configured to control a position and/or an orientation of the second subreflector so as to provide beam steering of the second beam, independently of the first beam. The control system may be configured to control an orientation of the main reflector so as to provide beam steering of the first beam and the second beam.

In a further embodiment, the control system may be configured to control at least a respective gimbal mechanism and/or a respective translation mechanism, wherewith the first subreflector is configured to steer the first beam.

In a still further embodiment, the control system may be configured to dynamically steer the at least one beam in response to a control signal. The control signal may be generated from the ground or from the spacecraft.

BRIEF DESCRIPTION OF THE DRAWINGS

Features of the invention are more fully disclosed in the following detailed description of the preferred embodiments, reference being had to the accompanying drawings, in which.

Figure 1B:
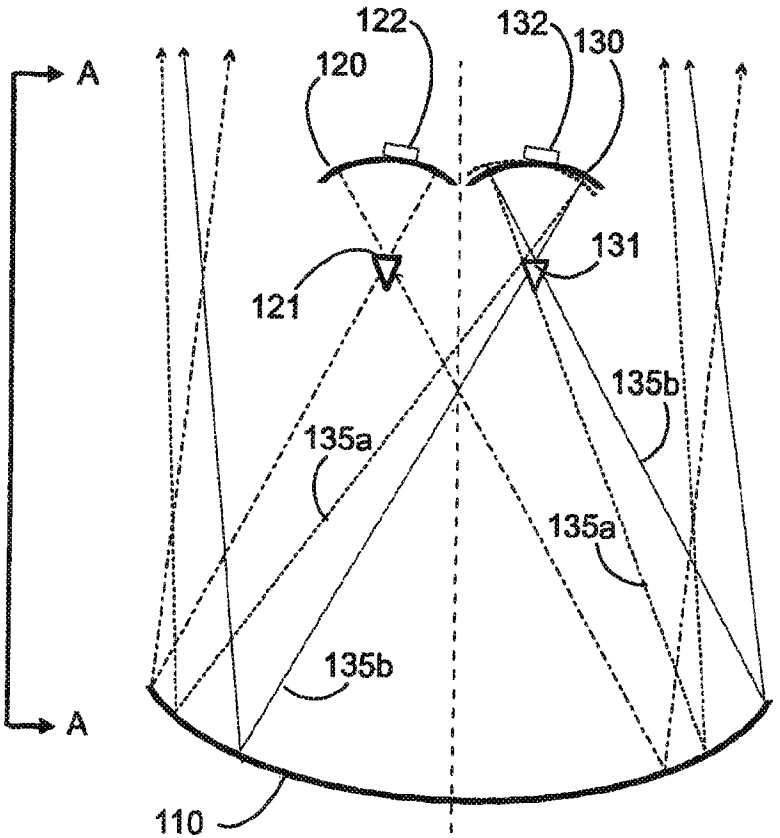
FIG. 1 illustrates an example of an antenna system according to an embodiment.

Throughout the drawings, the same reference numerals and characters, unless otherwise stated, are used to denote like features, elements, components, or portions of the illustrated embodiments. Moreover, while the subject invention will now be described in detail with reference to the drawings, the description is done in connection with the illustrative embodiments. It is intended that changes and modifications can be made to the described embodiments without departing from the true scope and spirit of the subject invention as defined by the appended claims.

DETAILED DESCRIPTION

Specific exemplary embodiments of the invention will now be described with reference to the accompanying drawings. This invention may, however, be embodied in many different forms, and should not be construed as limited to the embodiments set forth herein. Rather, these embodiments are provided so that this disclosure will be thorough and complete, and will fully convey the scope of the invention to those skilled in the art.

It will be understood that when an element is referred to as being "connected" or "coupled" to another element, it can be directly connected or coupled to the other element, or intervening elements may be present. Furthermore, "connected" or "coupled" as used herein may include wirelessly connected or coupled. It will be understood that although the terms "first" and "second" are used herein to describe various elements, these elements should not be limited by these terms. These terms are used only to distinguish one element from another element. Thus, for example, a first user terminal could be termed a second user terminal, and similarly, a second user terminal may be termed a first user terminal without departing from the teachings of the present invention. As used herein, the term "and/or" includes any and all combinations of one or more of the associated listed items. The symbol "/" is also used as a shorthand notation for "and/or".

The terms "spacecraft", "satellite" and "vehicle" may be used interchangeably herein, and generally refer to any orbiting satellite or spacecraft system.

Figure 1A:
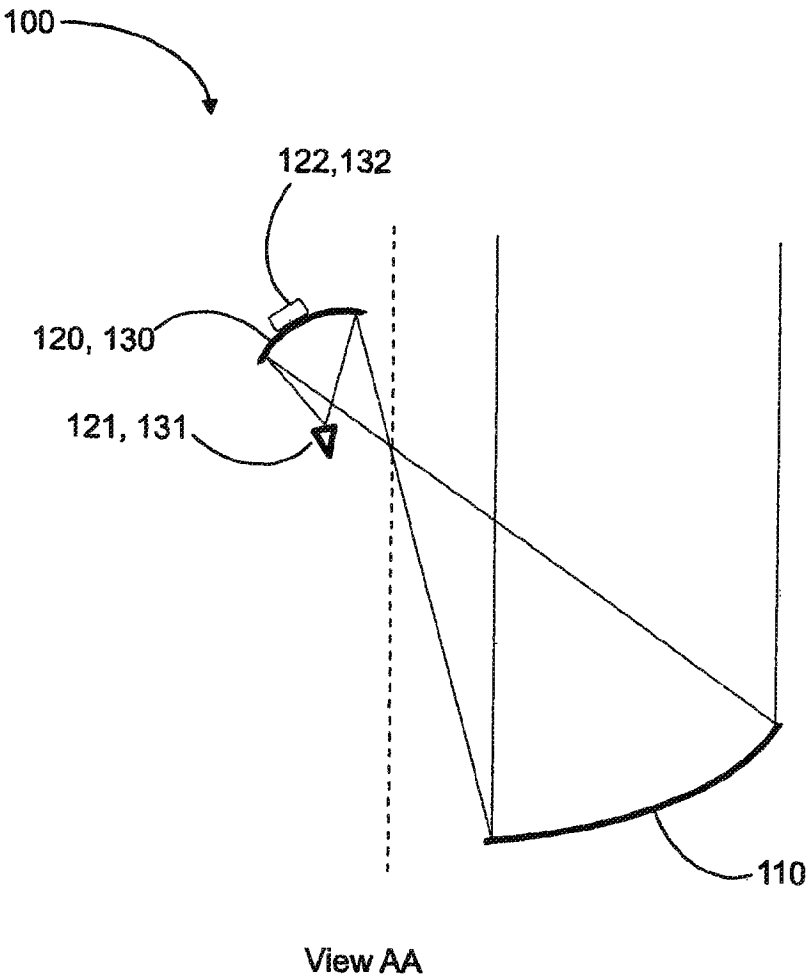

Referring now to FIG. 1*a* and FIG. 1*b*, two orthogonal views are presented of an example of an antenna system 100 arranged according to one implementation of the present techniques. In the illustrated implementation, antenna system 100 includes main reflector 110 and subreflectors 120 and 130. Each of subreflector 120 and 130 illuminates main reflector 110. Subreflector 120 may be illuminated by respective dedicated feed element 121; subreflector 130 may be illuminated by respective dedicated feed element and 131. It will be understood that although the respective feed elements 121 and 131 are illustrated as single feeds, one or both of feed elements 121 and 131 may be, for example, a small array of similar feed element. The feed element(s), moreover, may be of various types, for example a horn, helix, dipole, or microstrip. The respective feed elements 121 and 131 may operate within a common frequency band, or within respective, different, frequency bands.

In an embodiment, at least one of subreflector 120 and 130 may be configured to steer at least one beam. In the illustrated embodiment, for example, subreflector 130 is configured to be steered, in at least a first axis, by actuator 132 such that, in a first position, RF energy is reflected within the ray tracings 135*a*, and, in a second position, RF energy is reflected within the ray tracings 135*b*. Advantageously subreflector 130 may be contoured so as to provide beam shaping. In addition, subreflector 120 and/or main reflector 110 may also be contoured, and/or steerable. For example, subreflector 120 may be configured to be steered, in at least a first axis, by actuator 122. As a result, two or more independently-steerable and independently-shaped RF beams associated may be produced by antenna system 100.

Figure 2B:
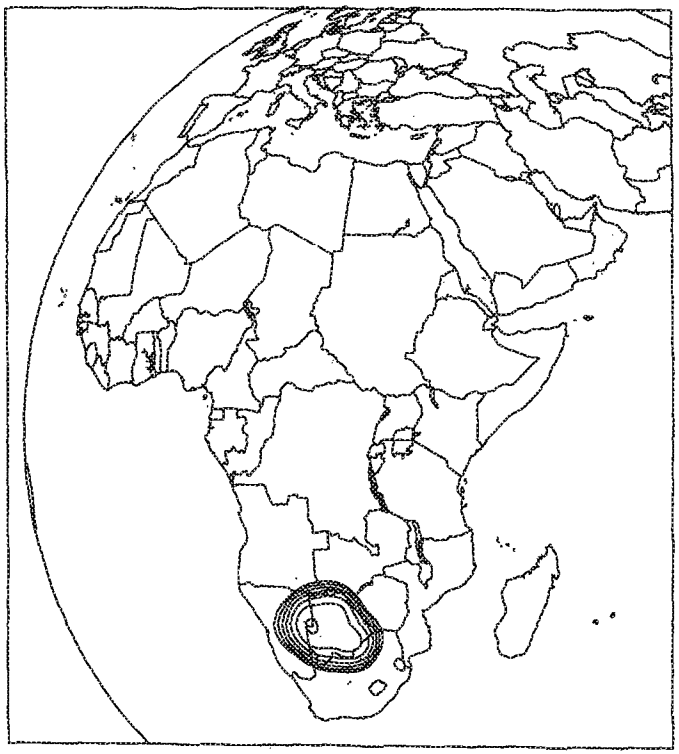
FIG. 2 illustrates an example of a reconfigurable coverage pattern resulting from operation of an embodiment of an antenna system.
Figure 2A:
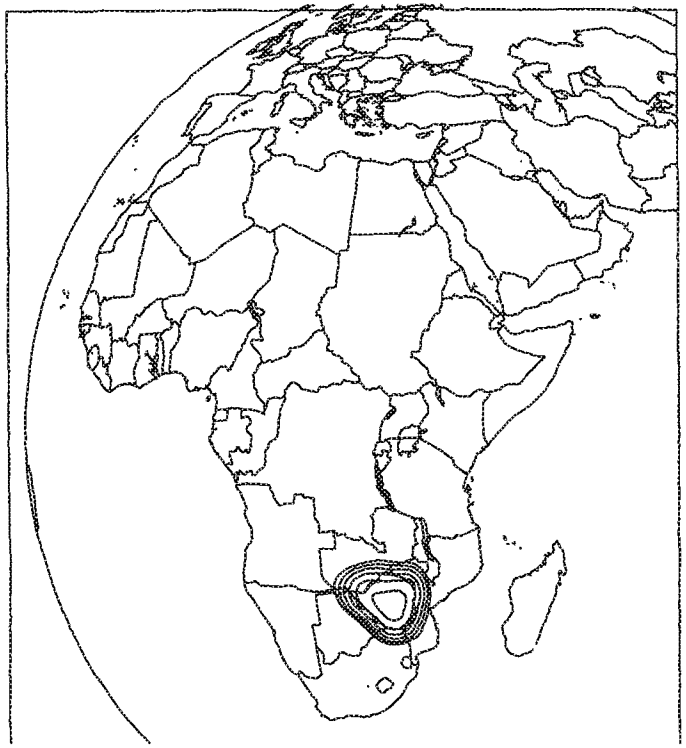

Advantageously, the presently disclosed techniques may be employed on an Earth-orbiting spacecraft, particularly a geosynchronous spacecraft that provides shaped beam coverage to particular service areas on the ground. For example, referring now to FIGS. 2*a* and 2*b*, a resultant shaped beam pattern on the ground associated with each of two subreflectors is illustrated. In FIG. 2*a* a beam pattern resulting from operation of antenna system 100 when both subreflectors are in an initial, or nominal, position is illustrated. Northern shaped beam pattern 201 represents signal characteristics of a service area in south west Europe, while a southern shaped beam pattern 202 represents signal characteristics of a service area covering Zimbabwe. In FIG. 2*b*, it may be observed that southern shaped beam pattern 202 has been shifted west, and now covers Botswana, whereas, northern shaped beam pattern 201 is substantially unchanged.

In an embodiment, antenna system 100 is configured to steer and/or translate subreflector 120 and/or subreflector 130. For example, either or both of subreflector 120 and 130 may be disposed on an actuator such as a gimbal and/or positioning mechanism wherewith a location and angular orientation of the subreflector may be adjusted in one to three axes.

Referring again to FIG. 1, it may be observed that the present techniques may be implemented in an offset fed, Gregorian antenna geometry. Other geometries are also within the contemplation of the present inventor. For example, an offset fed Cassegrain geometry (not illustrated) may be adapted.

Figure 3:
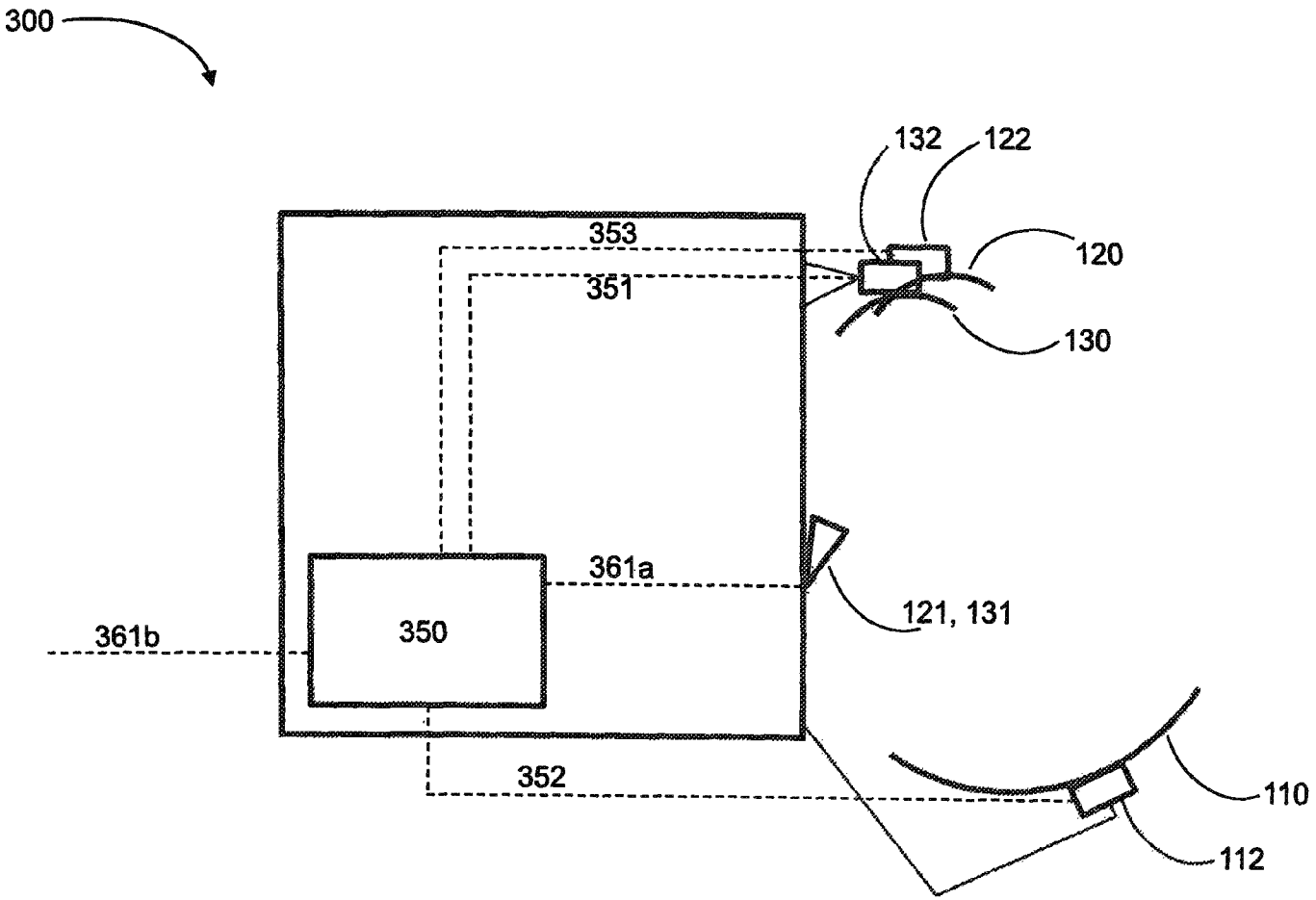
FIG. 3 illustrates a block diagram of a spacecraft according to an embodiment.

Referring now to FIG. 3, a simplified block diagram of a spacecraft 300, according to some implementations, is illustrated. Spacecraft 300 may be configured with an antenna system as described above, including main reflector 110, subreflectors 120 and 130, and feed elements 121 and 131, one or more of which components may be communicatively coupled to control system 350. Subreflector 130 may be configured to be steered, in at least a first axis, and/or translated, by actuator 132. Main reflector 110 may be configured to be steered, in at least a first axis, by actuator 112. In an embodiment, control system 350 may be configured to provide beam steering by controlling at least one of a position and an orientation of subreflector 132. For example control signals 351 may be operable to control actuator 132 to provide the aforementioned control of subreflector 130.

Control system 350 may be further configured to control, by way of control signals 353 to actuator 122, the position and/or orientation of subreflector 120 so as to provide beam steering of a second beam, independently of the first beam. In addition, control system 350 may be configured to control orientation of main reflector 112. Control signals 352 may be operable to control actuator 112 to steer main reflector 110.

Advantageously, control system 350 may be configured to dynamically steer a beam in response to a control signal. The control signal may be generated on the spacecraft, for example, by control system 350 in response to a characteristic of a communications signal 361*a* received by feed elements 121 and/or 131. Alternatively, or in addition, a control signal 361*b* may be generated on the ground, in response to which control system 350 may provide corresponding control signals to actuators 122, 132 and/or 112.

In some implementations, the subreflector/feed assemblies are translated from a nominal location at the focus of the main reflector, and placed adjacent to each other. As a result, one or both of the subreflectors may be slightly displaced from a focus of the main reflector. In implementations where a simple translation of the feed/subreflector assemblies does not allow the beams to be as close as desired, the feed/subreflector assemblies may be rotated so that their focal points are closer to each other, but the physical subreflectors are not interfering with each other.

One benefit of the presently disclosed techniques is that a single feed/subreflector combination may be redirected from servicing a first service area, to service a substantially different service area, without affecting the service coverage provided by any other feed/subreflector combination. Another benefit is that one or more subreflectors may be actively steered to continuously optimize performance to a given coverage area, without affecting the performance of any other feed element/array/subreflector combination. For example, a gimbaled first subreflector may be dynamically steered in response to a control signal by, for example, an RF autotracking technique, using a command signal originating either on the ground or on the spacecraft.

In some implementations, more than two feed/subreflector combinations can be used effectively. Particularly, this may be advantageous when the main reflector is large relative to the wavelength of operation. With a large enough reflector, and operating at higher frequencies, a large number of beams can be generated. Several of these antennas, working in conjunction, could provide multiple beam coverage with the beams in closer proximity than can be achieved with a single antenna while still enabling some or all of the beams to be independently shaped and steered.

Thus, techniques have been disclosed for providing independently steerable, shaped beams with an antenna system having a main reflector and at least two subreflectors. The foregoing merely illustrates principles of the invention. It will thus be appreciated that those skilled in the art will be able to devise numerous systems and methods which, although not explicitly shown or described herein, embody said principles of the invention and are thus within the spirit and scope of the invention as defined by the following claims.

What is claimed is:

1. An apparatus comprising:

an antenna system configured to provide at least a first beam and a second beam, the antenna system comprising:

a main reflector; and at least a first subreflector associated with the first beam and a second subreflector associated with the second beam; wherein the antenna system is disposed on a spacecraft and is communicatively coupled with a ground station;

each subreflector is configured to illuminate the main reflector, the first subreflector being directly illuminated by a first dedicated feed element such that no optical component is disposed between the subreflector and the first dedicated feed element; and the first subreflector is configured to steer the first beam, independently of the second beam, without moving the first dedicated feed element.

2. The antenna system of claim 1, wherein the first subreflector is configured to steer the first beam without affecting the orientation or shape of any other beam of the antenna system.

3. The antenna system of claim 2, wherein the antenna system is configured to steer the second beam by reorienting or translating the second subreflector.

4. The antenna system of claim 2, wherein the antenna system is configured to steer the first beam and the second beam by reorienting the main reflector.

5. The antenna system of claim 1, wherein the antenna system is configured to shape at least one of the first beam and the second beam.

6. The antenna system of claim 5, wherein at least one of the first subreflector and the second subreflector has a contoured surface so as to provide beam shaping.

7. The antenna system of claim 5, wherein the main reflector has a contoured surface so as to provide beam shaping.

8. The antenna system of claim 1, wherein the second subreflector is illuminated by a second dedicated feed element, the first feed element and the second feed element being configured to operate at a common frequency band.

9. The antenna system of claim 1, wherein the antenna system has an offset-fed Cassegrain or Gregorian geometry.

10. The antenna system of claim 1, further comprising at least one of (i) a respective gimbal mechanism and (ii) a respective translation mechanism, wherewith the first subreflector is configured to steer the first beam.

11. The antenna system of claim 1, wherein the spacecraft includes a control system configured to control at least one of a position and an orientation of at least the first subreflector; and the first beam is dynamically steered in response to a control signal from the control system.

12. The antenna system of claim 11, wherein the control signal is generated from the ground.

13. The antenna system of claim 11, wherein the control signal is generated from the spacecraft.

14. The antenna system of claim 1, wherein the feed element is at least one of a horn, helix, dipole, microstrip or a small array of similar feed elements for feeding signals to/from the subreflectors.

15. The antenna system of claim 1, wherein the second subreflector is illuminated by a second dedicated feed element, the first feed element and the second feed element being configured to operate at different frequency bands.

16. A spacecraft comprising:

a control system; and an antenna system configured to provide at least a first beam and a second beam, the antenna system comprising:

a main reflector; and at least a first subreflector associated with the first beam and a second subreflector associated with the second beam; wherein each subreflector is configured to illuminate the main reflector, the first subreflector being directly illuminated by a first dedicated feed element such that no optical component is disposed between the subreflector and the first dedicated feed element;

the first subreflector is configured to steer the first beam, independently of the second beam, without moving the first dedicated feed element; and the control system is configured to control at least one of a position and an orientation of at least the first subreflector.

17. The spacecraft of claim 16, wherein the control system is configured to control at least one of (i) a respective gimbal mechanism and (ii) a respective translation mechanism, wherewith the first subreflector is configured to steer the first beam.

18. The spacecraft of claim 16, wherein the control system is configured to control at least one of a position and an orientation of the second subreflector so as to provide beam steering of the second beam, independently of the first beam.

19. The spacecraft of claim 18, wherein the control system is configured to control an orientation of the main reflector so as to provide beam steering of the first beam and the second beam.

20. The spacecraft of claim 16, wherein the control system is configured to dynamically steer the first beam in response to a control signal.

21. The spacecraft of claim 20, wherein the control signal is generated from the spacecraft.

22. The spacecraft of claim 20, wherein the control signal is generated from the ground.

* * * * *